US009237405B2

(12) United States Patent
Pinto

(10) Patent No.: US 9,237,405 B2
(45) **Date of Patent: *Jan. 12, 2016**

(54) HEARING AID WITH AN ANTENNA

(71) Applicant: GN ReSound A/S, Ballerup (DK)

(72) Inventor: Alexandra Da Luz Pinto, Copenhagen (DK)

(73) Assignee: GN RESOUND A/S, Ballerup (DK)

( * ) Notice: Subject to any disclaimer, the term of this patent is extended or adjusted under 35 U.S.C. 154(b) by 0 days.

This patent is subject to a terminal disclaimer.

(21) Appl. No.: 14/199,511

(22) Filed: Mar. 6, 2014

(65) Prior Publication Data

US 2015/0131830 A1 May 14, 2015

(30) Foreign Application Priority Data

Nov. 11, 2013 (EP) ..... 13192317

(51) Int. Cl.
*H04R 25/00* (2006.01)

(52) U.S. Cl.
CPC ..... *H04R 25/554* (2013.01); *H04R 25/55* (2013.01); *H04R 25/65* (2013.01); *H04R 2225/021* (2013.01); *H04R 2225/51* (2013.01)

(58) Field of Classification Search
CPC ..... H04R 1/105; H04R 25/55; H04R 25/554; H04R 25/556; H04R 25/60; H04R 25/65; H04R 2225/021; H04R 2225/025; H04R 2225/51; H04R 2225/63; H01Q 1/273
USPC ..... 381/23.1, 313, 315, 322, 330, 331, 312, 381/324, 328, 381; 343/700 MS, 741, 866, 343/702, 718
See application file for complete search history.

(56) References Cited

U.S. PATENT DOCUMENTS 2,535,063 A 12/1950 Halstead
3,276,028 A 9/1966 Mayes et al.

(Continued)

FOREIGN PATENT DOCUMENTS

CN 1684549 A 10/2005
CN 101835082 A 9/2010

(Continued)

OTHER PUBLICATIONS

Advisory Action dated Aug. 29, 2014 for U.S. Appl. No. 13/740,471.

(Continued)

*Primary Examiner* — Huyen D Le
(74) *Attorney, Agent, or Firm* — Vista IP Law Group, LLP

(57) ABSTRACT

A hearing aid with an assembly, the assembly includes: a microphone; a signal processor for processing a first audio signal into a second audio signal compensating a hearing loss of a user; a wireless communication unit configured for wireless data communication; and an antenna for emission of an electromagnetic field, the antenna being coupled with the wireless communication unit, the antenna having a total length between three quarters of a wavelength of the emitted electromagnetic field and five quarters of the wavelength; wherein a part of the antenna extends from a first side of the assembly to a second side of the assembly; and wherein the antenna has a midpoint located at the part of the antenna extending from the first side to the second side, or a distance between the midpoint of the antenna and the part of the antenna is less than a quarter of the wavelength.

36 Claims, 10 Drawing Sheets

(56) References Cited

U.S. PATENT DOCUMENTS

| | | | |
|---|---|---|---|
| 4,334,315 | A | 6/1982 | Ono et al. |
| 4,924,237 | A | 5/1990 | Honda et al. |
| 5,621,422 | A | 4/1997 | Wang |
| 5,721,783 | A | 2/1998 | Anderson |
| 5,760,746 | A | 6/1998 | Kawahata |
| 5,761,319 | A | 6/1998 | Dar et al. |
| 6,515,629 | B1 | 2/2003 | Kuo |
| 7,002,521 | B2 | 2/2006 | Egawa et al. |
| 7,154,442 | B2 | 12/2006 | Van Wonterghem et al. |
| 7,256,747 | B2 | 8/2007 | Victorian et al. |
| 7,446,708 | B1 | 11/2008 | Nguyen et al. |
| 7,570,777 | B1 | 8/2009 | Taenzer et al. |
| 7,593,538 | B2 | 9/2009 | Polinske |
| 7,652,628 | B2 | 1/2010 | Zweers |
| 7,791,551 | B2 | 9/2010 | Platz |
| 7,978,141 | B2 | 7/2011 | Chi et al. |
| 8,494,197 | B2 | 7/2013 | Polinske et al. |
| 2004/0080457 | A1 | 4/2004 | Guo |
| 2004/0246179 | A1 | 12/2004 | Chen et al. |
| 2005/0068234 | A1 | 3/2005 | Hung et al. |
| 2005/0094840 | A1 | 5/2005 | Harano |
| 2005/0099341 | A1 | 5/2005 | Zhang et al. |
| 2005/0244024 | A1 | 11/2005 | Fischer et al. |
| 2005/0248717 | A1 | 11/2005 | Howell et al. |
| 2006/0012524 | A1 | 1/2006 | Mierke et al. |
| 2006/0018496 | A1 | 1/2006 | Niederdrank et al. |
| 2006/0061512 | A1 | 3/2006 | Asano et al. |
| 2006/0071869 | A1 | 4/2006 | Yoshino et al. |
| 2006/0115103 | A1 | 6/2006 | Feng et al. |
| 2006/0181466 | A1 | 8/2006 | Krupa |
| 2006/0192723 | A1 | 8/2006 | Harada et al. |
| 2007/0080889 | A1 | 4/2007 | Zhang |
| 2007/0171134 | A1 | 7/2007 | Yoshino et al. |
| 2007/0229369 | A1 | 10/2007 | Platz |
| 2007/0229376 | A1 | 10/2007 | Desclos et al. |
| 2007/0230714 | A1 | 10/2007 | Armstrong |
| 2007/0285321 | A1 | 12/2007 | Chung |
| 2008/0024375 | A1 | 1/2008 | Martin et al. |
| 2008/0056520 | A1 | 3/2008 | Christensen et al. |
| 2008/0079645 | A1 | 4/2008 | Higasa et al. |
| 2008/0231524 | A1 | 9/2008 | Zeiger et al. |
| 2009/0074221 | A1 | 3/2009 | Westermann |
| 2009/0196444 | A1 | 8/2009 | Solum |
| 2009/0231204 | A1 | 9/2009 | Shaker et al. |
| 2009/0231211 | A1 | 9/2009 | Zweers |
| 2009/0243944 | A1 | 10/2009 | Jung et al. |
| 2009/0273530 | A1 | 11/2009 | Chi et al. |
| 2009/0315787 | A1 | 12/2009 | Schatzle |
| 2010/0020994 | A1 | 1/2010 | Christensen et al. |
| 2010/0033380 | A1 | 2/2010 | Pascolini et al. |
| 2010/0158291 | A1 | 6/2010 | Polinske et al. |
| 2010/0158293 | A1 | 6/2010 | Polinske et al. |
| 2010/0158295 | A1 | 6/2010 | Polinske et al. |
| 2010/0172525 | A1 | 7/2010 | Angst et al. |
| 2010/0245201 | A1 | 9/2010 | Hossain et al. |
| 2010/0321269 | A1 | 12/2010 | Ishibana et al. |
| 2011/0007927 | A1 | 1/2011 | Hedrick et al. |
| 2011/0022121 | A1 | 1/2011 | Meskins |
| 2011/0129094 | A1 | 6/2011 | Petersen |
| 2011/0294537 | A1 | 12/2011 | Vance |
| 2012/0087506 | A1* | 4/2012 | Ozden ..... 381/23.1 |
| 2012/0093324 | A1 | 4/2012 | Sinasi |
| 2012/0154222 | A1 | 6/2012 | Oh et al. |
| 2013/0308805 | A1 | 11/2013 | Ozden |
| 2014/0010392 | A1* | 1/2014 | Kvist ..... 381/315 |
| 2014/0185848 | A1 | 7/2014 | Ozden et al. |
| 2014/0321685 | A1 | 10/2014 | Rabel |

FOREIGN PATENT DOCUMENTS

| | | | |
|---|---|---|---|
| DE | 3625891 | A1 | 2/1988 |
| DE | 10 2004 017832 | | 10/2005 |
| DE | 10 2008 022 127 | A1 | 11/2009 |
| EP | 1 231 819 | A2 | 8/2002 |
| EP | 1294049 | A1 | 3/2003 |
| EP | 1 465 457 | A2 | 10/2004 |
| EP | 1 465 457 | A3 | 10/2004 |
| EP | 1 589 609 | A2 | 10/2005 |
| EP | 1 594 188 | A1 | 11/2005 |
| EP | 1 681 903 | A2 | 7/2006 |
| EP | 1 763 145 | A1 | 3/2007 |
| EP | 1939984 | A1 | 2/2008 |
| EP | 1 953 934 | A1 | 8/2008 |
| EP | 2 200 120 | A2 | 6/2010 |
| EP | 2 200 120 | A3 | 6/2010 |
| EP | 2 207 238 | A1 | 7/2010 |
| EP | 2 229 009 | A1 | 9/2010 |
| EP | 2 302 737 | A1 | 3/2011 |
| EP | 2637251 | A1 | 11/2013 |
| EP | 2 680 366 | A1 | 1/2014 |
| EP | 2 723 101 | A2 | 4/2014 |
| EP | 2 723 101 | A3 | 4/2014 |
| EP | 2 765 650 | A1 | 8/2014 |
| JP | 2005-304038 | A | 10/2005 |
| JP | 2006025392 | | 1/2006 |
| JP | 2006-033853 | A | 2/2006 |
| WO | WO 98/44762 | | 10/1998 |
| WO | WO 0199226 | A1 | 12/2001 |
| WO | WO 03/026342 | | 3/2003 |
| WO | WO 2004/110099 | A2 | 12/2004 |
| WO | WO 2005/076407 | A2 | 8/2005 |
| WO | WO 2005/081583 | A1 | 9/2005 |
| WO | WO 2006/055884 | A2 | 5/2006 |
| WO | WO 2006122836 | A2 | 11/2006 |
| WO | WO 2007/045254 | A1 | 4/2007 |
| WO | WO 2007/140403 | A2 | 6/2007 |
| WO | 2008012355 | A1 | 1/2008 |
| WO | WO 2009/010724 | A1 | 1/2009 |
| WO | WO 2009/098858 | A1 | 8/2009 |
| WO | WO 2009/117778 | A1 | 10/2009 |
| WO | WO 2010/065356 | A1 | 6/2010 |
| WO | WO 2011099226 | | 8/2011 |
| WO | WO 2012059302 | A2 | 5/2012 |
| WO | WO 2014/090420 | A1 | 6/2014 |

OTHER PUBLICATIONS

Extended European Search Report dated May 14, 2014 for EP Patent Application No. 13192322.9.

Final Office Action dated Aug. 29, 2014 for U.S. Appl. No. 13/848,605.

First Technical Examination and Search Report dated Jun. 26, 2014 for DK Patent Application No. PA 2013 70667, 5 pages.

Non-Final Office Action dated Jul. 29, 2014 for U.S. Appl. No. 13/917,448.

Office Action dated Jun. 17, 2014 in Japanese Patent Application No. 2013-258396, 3 pages.

First Technical Examination dated Jun. 25, 2014 for DK Patent Application No. PA 2013 70665, 5 pages.

First Technical Examination dated Jun. 26, 2014 for DK Patent Application No. PA 201370664, 5 pages.

First Technical Examination and Search Report dated Jun. 27, 2014 for DK Patent Application No. PA 2013 70666, 5 pages.

Final Office Action dated May 19, 2014 for U.S. Appl. No. 13/740,471.

Non-Final Office Action dated Mar. 27, 2014 for U.S. Appl. No. 13/848,605.

Extended European Search Report dated Mar. 7, 2014 for EP Patent Application No. 11184503.8.

Extended European Search Report dated May 6, 2014 for EP Patent Application No. 13175258.6.

Extended European Search Report dated Apr. 17, 2014 for EP Patent Application No. 13192316.1.

Extended European Search Report dated Apr. 22, 2014 for EP Patent Application No. 13192323.7.

Non-Final Office Action dated May 22, 2014 for U.S. Appl. No. 13/271,170.

Final Office Action dated Feb. 27, 2014, for U.S. Appl. No. 13/271,180.

(56) References Cited

OTHER PUBLICATIONS

Extended European Search Report dated Mar. 7, 2014 for EP Patent Application No. 11184507.9 (P81101358EP00).
Second Danish Office Action dated Apr. 24, 2012 for Danish Patent Application No. PA 2010 00931.
First Danish Office Action dated Apr. 26, 2011 for Danish Patent Application No. PA 2010 00931.
Danish Office Action dated Apr. 30, 2012 for Danish Patent Application No. PA 2011 70566.
Danish Office Action dated May 1, 2012 for Danish Patent Application No. PA 2011 70567.
English Abstract of Foreign Reference DE 10 2008 022 127 A1 (included in 1st page of Foreign Ref.
Third Danish Office Action dated Oct. 17, 2012 for Danish Patent Application No. PA 2010 00931.
First Office Action dated Feb. 12, 2013 for Japanese Patent Application No. 2011-224711.
Fourth Danish Office Action , Intention to Grant dated Feb. 13, 2013 for Danish Patent Application No. PA 2010 00931.
Notice of Reasons for Rejection dated May 21, 2013 for Japanese Patent Application No. 2011-224705.
Non-final Office Action dated Oct. 8, 2013 for U.S. Appl. No. 13/271,180.
Chinese Office Action and Search Report dated Nov. 12, 2013 for related CN Patent Application No. 201110317264.6.
Chinese Office Action and Search Report dated Dec. 4, 2013 for related CN Patent Application No. 201110317229.4.
1st Technical Examination and Search Report dated Jan. 25, 2013 for DK Patent Application No. PA 2012 70412, 4 pages.
1st Technical Examination and Search Report dated Jan. 24, 2013 for DK Patent Application No. PA 2012 70411, 5 pages.
Second Technical Examination dated Aug. 6, 2013 for DK Patent Application No. PA 2012 70411, 2 pages.
Second Technical Examination—Intention to Grant dated Jul. 8, 2013 for DK Patent Application No. PA 2012 70412, 2 pages.
Non-final Office Action dated Jan. 2, 2014 for U.S. Appl. No. 13/740,471.
First Technical Examination and Search Report Dated Jan. 18, 2013 for DK Patent Application No. PA 2012 70410, 4 pages.
Second Technical Examination dated Jul. 12, 2013, for DK Patent Application No. PA 2012 70410, 2 pages.
Third Technical Examination dated Jan. 31, 2014, for DK Patent Application No. PA 2012 70410, 2 pages.
Non-final Office Action dated Nov. 18, 2014 for U.S. Appl. No. 13/271,180.
Conway et al., Antennas for Over-Body-Surface Communication at 2.45 GHz, Apr. 2009, IEEE Transactions on Antennas and Propagation, vol. 57, No. 4, pp. 844-855.
Non-final Office Action dated Nov. 19, 2014 for U.S. Appl. No. 13/931,556.
Non-final Office Action dated Dec. 18, 2014 for U.S. Appl. No. 13/740,471.
Final Office Action dated Dec. 31, 2014 for U.S. Appl. No. 13/271,170.
Non-final Office Action dated Jan. 5, 2015 for U.S. Appl. No. 13/848,605.
Extended European Search Report dated Oct. 9, 2014 for EP Patent Application No. 14181165.3.
"Novelty Search including a Preliminary Patentability Opinion Report", in reference to P81007295DK02, dated Jul. 28, 2011 (8 pages).
"Novelty Search including a Preliminary Patentability Opinion Report", in reference to P81101358DK01, dated Jul. 28, 2011 (8 pages).
Non-final Office Action dated Feb. 5, 2015 for U.S. Appl. No. 14/198,396.
Non-final Office Action dated Feb. 24, 2015 for U.S. Appl. No. 14/202,486.
Notice of Allowance dated Mar. 5, 2015 for U.S. Appl. No. 13/917,448.
Notice of Allowance and Fee(s) Due dated May 22, 2015 for U.S. Appl. No. 13/848,605.
Non-final Office Action dated Jun. 10, 2015 for U.S. Appl. No. 14/199,263.
Notice of Allowance and Fee(s) Due dated Jun. 18, 2015, for U.S. Appl. No. 13/917,448.
Communication pursuant to Article 94(3) EPC dated Mar. 16, 2015, for related European Patent Application No. 11 184 503.8, 12 pages.
Communication pursuant to Article 94(3) EPC dated Mar. 19, 2015, for related European Patent Application No. 11 184 507.9, 12 pages.
Non-final Office Action dated Jul. 1, 2015 for U.S. Appl. No. 14/199,070.
Notice of Allowance dated Apr. 24, 2015 for U.S. Appl. No. 13/931,556.
First Technical Examination and Search Report dated Mar. 9, 2015, for related Danish Patent Application No. PA 2014 70489.
Non-final Office Action dated May 7, 2015 for U.S. Appl. No. 13/271,180.
Advisory Action dated May 14, 2015 for U.S. Appl. No. 13/271,170.
Final Office Action dated Jul. 15, 2015 for related U.S. Appl. No. 13/740,471.
Notice of Allowance and Fees Due dated Aug. 3, 2015 for related U.S. Appl. No. 13/931,556.
Non-final Office Action dated Aug. 17, 2015 for related U.S. Appl. No. 14/198,396.
Non-final Office Action dated Aug. 25, 2015 for related U.S. Appl. No. 14/202,486.
Notice of Allowance and Fee(s) Due dated Sep. 3, 2015 for related U.S. Appl. No. 13/848,605.
Notice of Allowance and Fee(s) Due dated Sep. 25, 2015 for related U.S. Appl. No. 13/271,170.

* cited by examiner

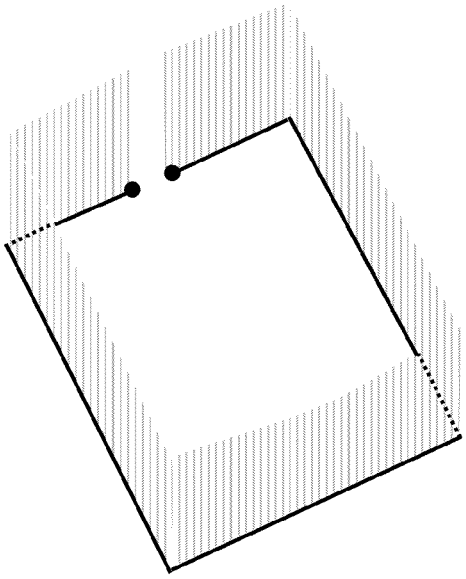
FIG. 10. Prior art – small loop (L<λ/4)
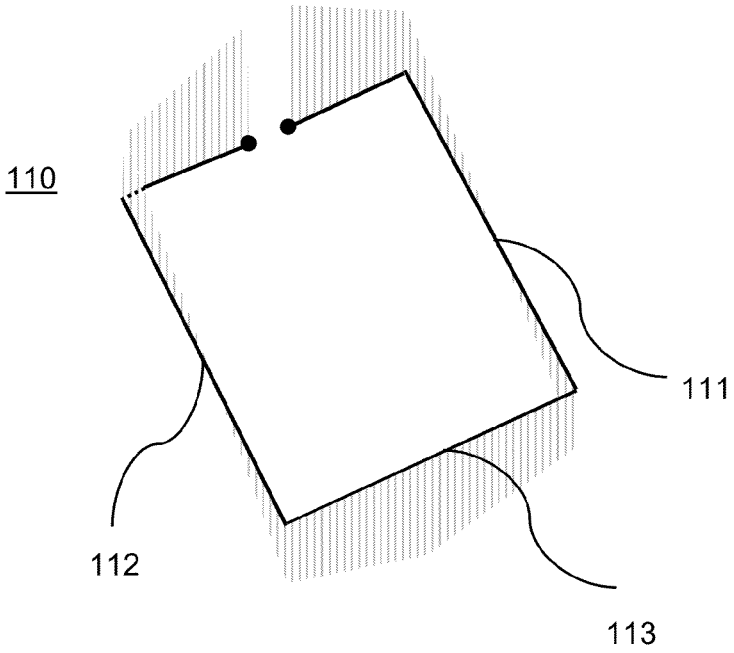
FIG. 11

HEARING AID WITH AN ANTENNA

RELATED APPLICATION DATA

This application claims priority to and the benefit of Danish Patent Application No. PA 2013 70665 filed on Nov. 11, 2013, pending, and European Patent Application No. 13192317.9 filed on Nov. 11, 2013, pending. The entire disclosures of both of the above applications are expressly incorporated by reference herein.

TECHNICAL FIELD

The present disclosure relates to the field of hearing aids having antennas, especially adapted for wireless communication, such as for wireless communication with accessory and/or other hearing aids.

BACKGROUND

Hearing aids are very small and delicate devices and comprise many electronic and metallic components contained in a housing small enough to fit in the ear canal of a human or behind the outer ear. The many electronic and metallic components in combination with the small size of the hearing aid housing impose high design constraints on radio frequency antennas to be used in hearing aids with wireless communication capabilities.

Moreover, the antenna in the hearing aid has to be designed to achieve a satisfactory ear-to-ear performance despite the size limitation and other high design constraints.

SUMMARY

It is an object to overcome at least some of the disadvantages as mentioned above, and it is a further object to provide a hearing aid. The hearing aid with a hearing aid assembly comprises a housing for accommodating the hearing aid assembly, a microphone for reception of sound and conversion of the received sound into a corresponding first audio signal, and a signal processor for processing the first audio signal into a second audio signal compensating a hearing loss of a user of the hearing aid. The hearing aid comprises a wireless communication unit configured for wireless data communication, and an antenna for emission or reception of an electromagnetic field. The antenna is interconnected with the wireless communication unit, and the antenna may have a total length between three quarters of a wavelength and five quarters of a wavelength. At least a part of the antenna extends from a first side of the hearing aid to a second side of the hearing aid, and the antenna may have a midpoint at said part of the antenna or a distance between the antenna midpoint and said part may be less than a quarter of a wavelength.

In the following, the embodiments are described primarily with reference to a hearing aid, such as a binaural hearing aid. It is however envisaged that the disclosed features and embodiments may be used in combination with any aspect described herein.

It is an advantage of the hearing aid disclosed herein that a wireless communication around the head which is more robust to impairments and which results in a better ear-to-ear connectivity for the hearing aid may be provided. The wireless communications unit is configured for wireless data communication, and in this respect interconnected with the antenna for emission and reception of an electromagnetic field. The wireless communications unit may comprise a transmitter, a receiver, a transmitter-receiver pair, such as a transceiver, a radio unit, etc. The wireless communications unit may be configured for communication using any protocol as known for a person skilled in the art, including Bluetooth, WLAN standards, manufacture specific protocols, such as tailored proximity antenna protocols, such as proprietary protocols, such as low-power wireless communication protocols, etc.

The current flowing in the antenna may form standing waves along the length of the antenna, and for proper operation, the antenna may be operated at, or approximately at, a frequency at which the length of the antenna is between three quarters of a wavelength of the emitted electromagnetic field and five quarters of a wavelength of the emitted electromagnetic field. Thus, the antenna may comprise several sections interconnected in order to obtain a combined length of the antenna appropriate for emission of the desired wavelength of the electromagnetic field.

The antenna having a total length between ¾ of a wavelength and 5/4 of a wavelength and having a midpoint at or near the at least part of the antenna extending from a first side of the hearing aid to a second side of the hearing aid may be structured so that the current has a maximum in or proximate the said part. Furthermore, the antenna may be structured so that the combined length of the antenna elements has the desired length for effective emission of the desired electromagnetic field.

In some embodiments, the desired distance between the antenna midpoint and said part may preferably be a quarter wavelength or less than a quarter wavelength of the electromagnetic radiation. However, it is envisaged that the path of current flowing in the antenna exhibits a number of bends due to the different orientations of the sections provided in such a way that the antenna fits inside the hearing aid housing while simultaneously being configured for a maximum being reached in the desired section of the antenna at the desired electromagnetic frequency. The exact location of the maximum amplitude of the current may depend on the magnitude of the current at the antenna excitation points and the length of the antenna.

In some embodiments, a current running through the antenna has a maximum amplitude in the part of the antenna extending from a first side to a second side of the hearing aid during emission of the electromagnetic field. A maximum amplitude in the said part of the antenna may provide an optimal transmission that supports the circumvention of the obstacle presented by the head.

The part of the antenna extending from a first side of the hearing aid to a second side of the hearing aid may be a linear section, e.g. such as a rod-shaped section, and may be positioned so that the longitudinal direction of the said part is parallel to an ear to ear axis when the housing is worn in its operational position by the user, or in other words perpendicular to, or substantially perpendicular to, the surface of the head or any other body part proximate the operational position of the said part.

In one or more embodiments, having a maximum amplitude in or proximate the part of the antenna extending from a first side of the hearing aid to a second side of the hearing aid, may make the antenna suitable for wireless communication between devices located in opposite ears or proximate opposite ears due to advantageous features of the emitted electromagnetic field as further explained below.

The housing of the hearing aid may be a behind-the-ear housing configured to be positioned behind the ear of the user during use. The first side of the housing may e.g. be a first longitudinal side of the hearing aid, and the second side of the housing may be e.g. a second longitudinal side of the hearing aid. The antenna may be accommodated in the housing with a longitudinal direction of the antenna extending along the length of the housing. Preferably, the antenna may be accommodated within the hearing aid housing, preferably so that the antenna is positioned inside the hearing aid housing without protruding out of the housing.

In one or more embodiments, the antenna may form a loop. The antenna may comprise several sections interconnected so as to form a loop. The loop antenna may form an open loop, with a space between two antenna ends.

The antenna may have a first end and a second end, and the total length of the antenna may be a total length of the antenna between the first end and the second end. A distance along and/or a length of the antenna may be measured along the antenna structure.

In one or more embodiments, an absolute relative difference between the total length of the antenna and the wavelength may be less than a threshold. With the antenna having a first end and a second end, a relative difference between a length of the antenna from the first end to the midpoint and a length from the second end to the midpoint may be less than a threshold. Thus, for example the length of the antenna as measured from the first end to the midpoint may be substantially equal to the length of the antenna as measured from the second end to the midpoint. Thus, the midpoint may be an absolute geometric midpoint, or the midpoint may be an approximate midpoint provided within an interval, such as within an interval of +/−5%, +/−10%, +/−15%, etc.

The antenna may have a first antenna section extending along a first side of the hearing aid assembly, the first antenna section having a first end and a second end. The antenna may have a second antenna section extending along a second side of the hearing aid assembly, the second antenna section having a first end and a second end. The antenna may have a third antenna section, the third antenna section being connected with the second end of the first antenna section and with the second end of the second antenna section. The antenna may have an excitation point for the antenna being provided at or near the first end of the first and/or second antenna section. The first and/or the second section of the antenna may be connected to the wireless communication unit and configured so that the third section conducts current of large amplitude at the desired transmission frequency of the electromagnetic field. In some embodiments, the midpoint of the antenna may be located at the third section. Hereby, a major part of the power of the electromagnetic field emitted by the antenna and propagating from the antenna at one ear around the head to either an opposite ear of the user or to an external device, such as an accessory, is contributed by the third section of the antenna. Preferably, the current in the antenna has a maximum current amplitude at the third section.

Additionally or alternatively, the second side of the hearing aid may be opposite the first side.

In one or more embodiments, the first antenna section has a first length, the second antenna section has a second length, and the third antenna section has a third length. A sum of the first length, the second length and the third length may then be a total length of the antenna.

The first section of the antenna may be a first linear section, e.g. such as a rod-shaped section, that is positioned so that the longitudinal direction of the first section is perpendicular to the ear to ear axis when the housing is worn in its operational position by the user, or in other words parallel to, or substantially parallel to, the surface of the head or any other body part proximate the operational position of the first section. The second section of the antenna may be a second linear section, e.g. such as a rod-shaped section, that is positioned parallel to the first section.

In one or more embodiments, a distance from a first end of the first or second antenna section to the third antenna section may be between a quarter of a wavelength and half a wavelength.

Preferably, a midpoint of the antenna may be positioned at the third section. The third section may extend from proximate the first side to proximate the second side of the hearing aid assembly. The third section may be a linear section, e.g. such as a rod-shaped section, that is positioned so that the longitudinal direction of the third section is parallel to the ear to ear axis when the housing is worn in its operational position by the user, or in other words perpendicular to, or substantially perpendicular to, the surface of the head or any other body part proximate the operational position of the third section.

The configuration of the third section, which is positioned so that current flows with a maximum amplitude in the third section in a direction in parallel to, or substantially in parallel to, an ear to ear axis of the user makes the antenna suitable for wireless communication around the head of a user between devices located in opposite ears or proximate opposite ears due to advantageous features of the emitted electromagnetic field.

In general, various sections of the antenna may be formed having different geometries, the sections may be wires or patches, bend or straight, long or short as long as they obey the above relative configuration with respect to each other such that at a total length of the antenna is between three quarters of a wavelength and five quarters of a wavelength, and the antenna has midpoint at a part of the antenna extending from a first side of the hearing aid to a second side of the hearing aid (or a distance between the antenna midpoint and said part extending from a first side of the hearing aid to a second side of the hearing aid is less than a quarter wavelength). Hereby, any attenuation experienced by the surface wave travelling around the head may be reduced.

It is an advantage that, during operation, the third section of the antenna contributes to an electromagnetic field that travels around the head of the user thereby providing a wireless data communication that is robust and has low loss.

Due to the current component normal to the side of the head or normal to any other body part, the surface wave of the electromagnetic field may be more efficiently excited. Hereby, for example an ear-to-ear path gain may be improved, such as by 10-15 dB, such as by 10-30 dB.

Considering the nature of the antenna, the antenna may be a balanced antenna, thus an antenna which may be more robust to noise.

In one or more embodiments, one end of the antenna may be grounded. One end may be connected to a ground plane. The ground plane may be any ground plane provided in the hearing aid, typically such as for example a printed circuit board. The ground plane may be e.g. a ground potential, such as a zero potential or a relative ground potential.

An antenna excitation point may be provided at or near the first and/or the second end of the antenna. An excitation point is electrically connected to a source, such as the wireless communication unit, a radio chip, such as a transceiver, a receiver, a transmitter, etc. The antenna may be excited using any conventional means, using a direct or an indirect or coupled feed, and for example be fed using a feed line, such as a transmission line. The current induced in the antenna may have a first local maximum at a proximate excitation point of the antenna. The current induced in the antenna may have an absolute maximum proximate the antenna midpoint, preferably at a part extending from the first side of the hearing aid to the second side of the hearing aid.

In one embodiment, the antenna may comprise two excitation points, a first excitation point at a first end of the antenna and a second excitation point at another end of the antenna. The antenna may be a dipole antenna comprising two excitation points, a first excitation point at a first end of the antenna and a second excitation point at another end of the antenna. By using a dipole antenna with the present disclosure, a smaller impact on antenna performance from PCB and other metal components may be obtained.

In another embodiment, a shape of the first section may be symmetrical to a shape of the second section.

The hearing aid disclosed herein may be configured for operation in ISM frequency band. Preferably, the antennas are configured for operation at a frequency of at least 1 GHz, such as at a frequency between 1.5 GHz and 3 GHz such as at a frequency of 2.4 GHz.

A hearing aid with an assembly, the assembly includes: a microphone for reception of sound and conversion of the received sound into a corresponding first audio signal; a signal processor for processing the first audio signal into a second audio signal compensating a hearing loss of a user of the hearing aid; a wireless communication unit configured for wireless data communication; and an antenna for emission of an electromagnetic field, the antenna being coupled with the wireless communication unit, the antenna having a total length between three quarters of a wavelength of the emitted electromagnetic field and five quarters of the wavelength; wherein a part of the antenna extends from a first side of the assembly to a second side of the assembly; and wherein the antenna has a midpoint located at the part of the antenna extending from the first side to the second side, or a distance between the midpoint of the antenna and the part of the antenna is less than a quarter of the wavelength.

Optionally, a current running through the antenna has a maximum amplitude in the part of the antenna extending from a first side of the assembly during emission of the electromagnetic field.

Optionally, the antenna forms a loop.

Optionally, an absolute relative difference between the total length of the antenna and the wavelength is less than a threshold.

Optionally, the second side is opposite the first side.

Optionally, the microphone is a part of a behind-the-ear unit configured to be positioned behind an ear of the user during use, and wherein the first side is a first longitudinal side of the assembly, and the second side is a second longitudinal side of the assembly.

Optionally, one end of the antenna is grounded.

Optionally, the antenna has a first end and a second end, and a relative difference between a length of the antenna from the first end to the midpoint and a length from the second end to the midpoint is less than a threshold.

Optionally, the antenna has an excitation point at a first end of the antenna, or two excitation points respectively at the first end and a second end of the antenna.

Optionally, the antenna is a part of an assembly, and wherein the antenna has: a first antenna section extending along the first side of the assembly, the first antenna section having a first end and a second end, a second antenna section extending along the second side of the assembly, the second antenna section having a first end and a second end, and a third antenna section, the third antenna section being connected with the second end of the first antenna section and with the second end of the second antenna section, wherein the first end of the first antenna section has an excitation point and/or the first end of the second antenna section has an excitation point.

Optionally, the first antenna section has a first length, the second antenna section has a second length, and the third antenna section has a third length, and wherein a sum of the first length, the second length and the third length is the total length of the antenna.

Optionally, a distance from the first end of the first antenna section or the first end of the second antenna section to the third antenna section is between a quarter wavelength and a half wavelength.

Optionally, the midpoint of the antenna is at the third section.

Optionally, the third section is extending from proximate the first side to proximate the second side of the assembly.

Optionally, a shape of the first section is symmetrical to a shape of the second section.

Other aspects and features will be evident from reading the following detailed description.

BRIEF DESCRIPTION OF THE DRAWINGS

FIG. 10 is a schematic view of the current distribution along a prior-art antenna with a small loop having a length smaller than $\lambda/4$, FIG. 11 is a schematic view of the current distribution along an antenna according to an embodiment of the present disclosure.

DETAILED DESCRIPTION OF THE DRAWINGS

Figure 1:
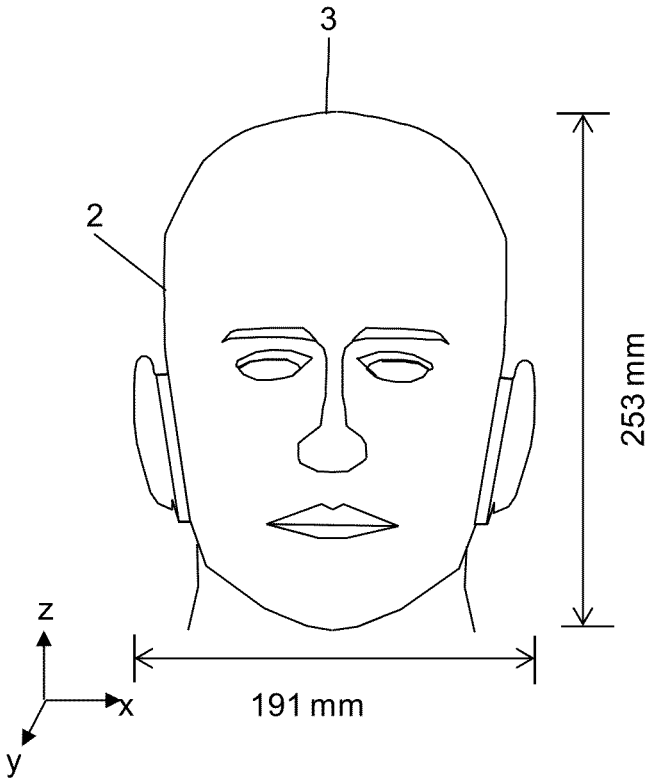
FIG. 1 is a phantom head model of a user together with an ordinary rectangular three dimensional coordinate system with an x, y and z axis for defining the geometrical anatomy of the head of the user.

Various embodiments are described hereinafter with reference to the figures, in which exemplary embodiments are shown. The claimed invention may, however, be embodied in different forms and should not be construed as being limited to the embodiments set forth herein. Like reference numerals refer to like elements throughout. Like elements will, thus, not be described in detail with respect to the description of each figure. It should also be noted that the figures are only intended to facilitate the description of the embodiments.

They are not intended as an exhaustive description of the claimed invention or as a limitation on the scope of the claimed invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

As used herein, the term "antenna" refers to an electrical device which converts electric power into radio waves. An antenna, such as an electric antenna, may comprise an electrically conductive material connected to e.g. a radio chip, a receiver or a transmitter.

FIG. 1 is a phantom head model of a user seen from the front. When designing antennas for wireless communication proximate the human body, the human head can be approximated by a rounded enclosure with sensory organs, such as the nose, ears, mouth and eyes attached thereto. Such a rounded enclosure 3 is illustrated in FIG. 1. In FIG. 1, the phantom head model is shown from the front together with an ordinary rectangular three dimensional coordinate system with an x, y and z axis for defining orientations with relation to the head.

Every point of the surface of the head has a normal and tangential vector. The normal vector is orthogonal to the surface of the head while the tangential vector is parallel to the surface of the head. An element extending along the surface of the head is said to be parallel to the surface of the head, likewise a plane extending along the surface of the head is said to be parallel to the surface of the head, while an object or a plane extending from a point on the surface of the head and radially outward from the head into the surrounding space is said to be orthogonal to the head.

As an example, the point with reference numeral 2 in FIG. 1 furthest to the left on the surface of the head in FIG. 1 has tangential vectors parallel to the yz-plane of the coordinate system, and a normal vector parallel to the x-axis. Thus, the y-axis and z-axis are parallel to the surface of the head at the point 2 and the x-axis is orthogonal to the surface of the head at the point 2.

The user modelled with the phantom head of FIG. 1 is standing erect on the ground (not shown in the figure), and the ground plane is parallel to xy-plane. The torso axis from top to toe of the user is thus parallel to the z-axis, whereas the nose of the user is pointing out of the paper along the y-axis.

The axis going through the right ear canal and the left ear canal is parallel to the x-axis in the figure. This ear to ear axis (ear axis) is thus orthogonal to the surface of the head at the points where it leaves the surface of the head. The ear to ear axis as well as the surface of the head will in the following be used as reference when describing specific configurations of the elements in one or more of the embodiments.

Since the auricle of the ear is primarily located in the plane parallel to the surface of the head on most test persons, it is often described that the ear to ear axis also functions as the normal to the ear. Even though there will be variations from person to person as to how the plane of the auricle is oriented.

The in the ear canal type of hearing aid will have an elongated housing shaped to fit in the ear canal. The longitudinal axis of this type of hearing aid is then parallel to the ear axis, whereas the face plate of the in the ear type of hearing aid will typically be in a plane orthogonal to the ear axis. The behind the ear type of hearing aid will typically also have an elongated housing most often shaped as a banana to rest on top of the auricle of the ear. The housing of this type of hearing aid will thus have a longitudinal axis parallel to the surface of the head of the user.

Figure 2:
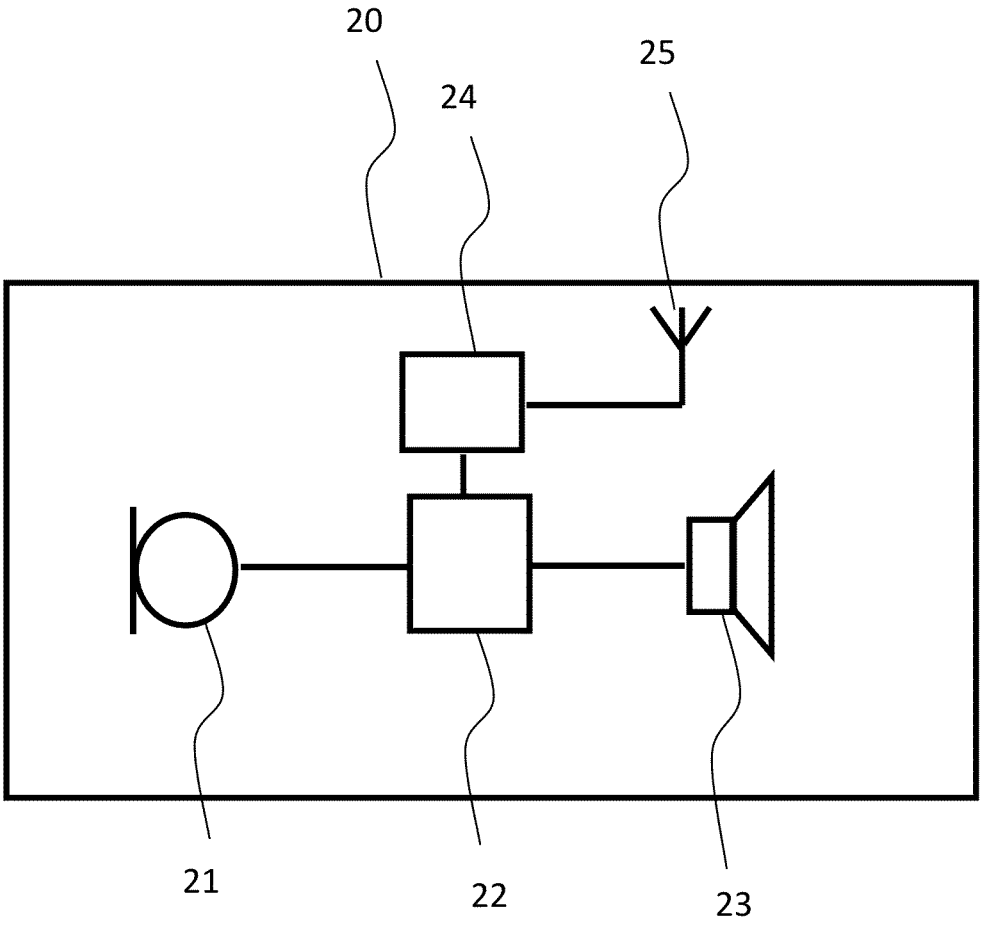
FIG. 2 shows a block-diagram of a hearing aid.

FIG. 2 shows a block-diagram of a hearing aid. In FIG. 2, the hearing aid 20 comprises a microphone 21 for receiving incoming sound and converting it into an audio signal, i.e. a first audio signal. The first audio signal is provided to a signal processor 22 for processing the first audio signal into a second audio signal compensating a hearing loss of a user of the hearing aid. A receiver is connected to an output of the signal processor 22 for converting the second audio signal into an output sound signal, e.g. a signal modified to compensate for a users hearing impairment, and provides the output sound to a speaker 23. Thus, the hearing instrument signal processor 22 may comprise elements such as amplifiers, compressors and noise reduction systems, etc. The hearing aid may further have a feedback loop for optimizing the output signal. The hearing aid furthermore has a wireless communication unit 24 (e.g. a transceiver) for wireless data communication interconnected with an antenna 25 for emission and reception of an electromagnetic field. The wireless communication unit 24 may connect to the hearing aid signal processor 22 and antenna 25 for communicating with external devices, or with another hearing aid, located at another ear, in a binaural hearing aid system.

The antenna does not, or substantially does not, emit an electromagnetic field in the direction of the ear to ear axis of the user when the hearing aid housing is positioned in its operational position at the ear of the user; rather, the antenna emits an electromagnetic field that propagates in a direction parallel to the surface of the head of the user when the hearing aid housing is positioned in its operational position during use, whereby the electric field of the emitted electromagnetic field has a direction that is orthogonal to, or substantially orthogonal to, the surface of the head at least along the side of the head at which the antenna is positioned during operation. In this way, propagation loss in the tissue of the head is reduced as compared to propagation loss of an electromagnetic field with an electric field component that is parallel to the surface of the head. Diffraction around the head makes the electromagnetic field emitted by the antenna propagate from one ear and around the head to the opposite ear.

Figure 3:
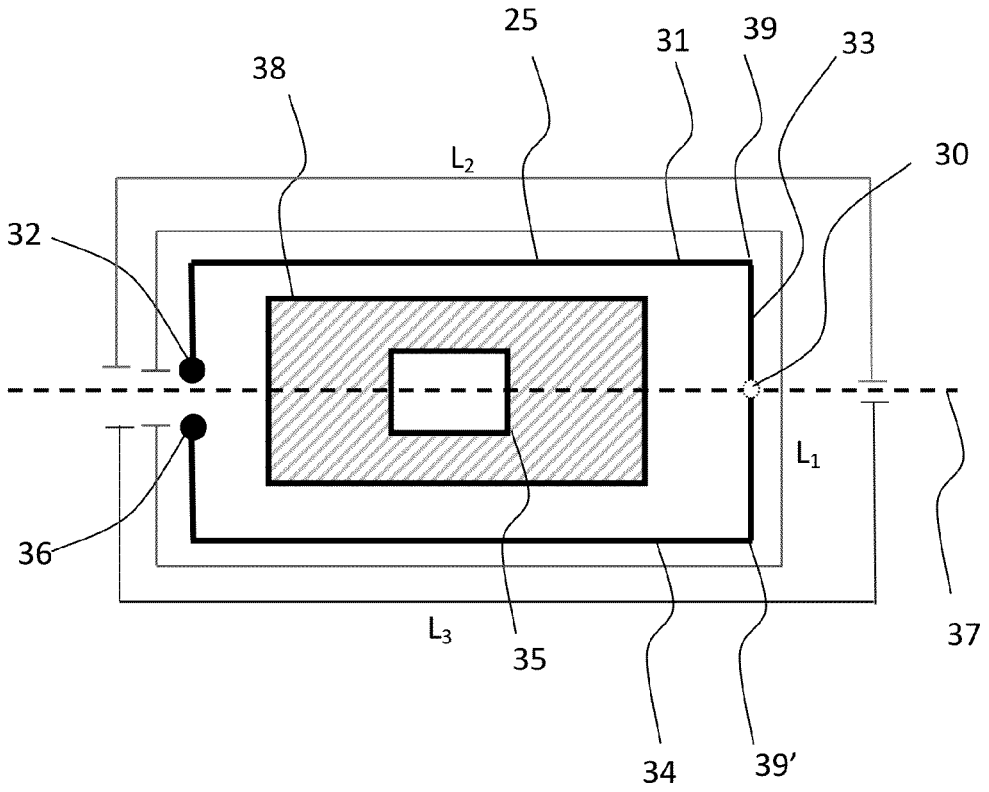
FIG. 3 shows schematically an exemplary implementation of a hearing aid comprising an antenna according to an embodiment of the present disclosure.

FIG. 3 shows an embodiment of a hearing aid comprising an antenna 25, a wireless communication unit 35 and a ground plane 38. Antenna 25 comprises a first antenna section 31, a second antenna section 34, and a third antenna section 33. The antenna has a first end 32, and a second end 36. The first antenna section 31 extends along a first side of the hearing aid assembly. The first antenna section 31 has a first end 32 and a second end 39. The second antenna section 34 extends along a second side of the hearing aid assembly. The second antenna section 34 has a first end 36 and a second end 39'. The third antenna section 33 is connected with the second end 39 of the first antenna section and with the second end 39' of the second antenna section. In the present example, the second ends 39, 39' are provided as edge points; however, the second ends may be defined as positions at which the antenna starts to extend from a first side to a second side of the hearing aid. An excitation point for the antenna 25 is provided at the first end 32, 36 of the first and/or second antenna sections 31, 34.

In one or more embodiments, a shape of the first section 31 is symmetrical to a shape of the second section 34. The first antenna section 31 and the second antenna section 34 may form identical antenna structures. For example, both the first antenna section 31 and the second antenna section 34 may form a structure having a same form and same dimensions. The structure of antenna 25 may be symmetrical with respect to a partition plane 37, resulting in a structure of the first antenna section 31 being symmetrical to the structure of the second antenna section 34 with respect to partition plane 37.

The partition plane 37 may be a symmetry plane 37 for the antenna 25 so that the first section 31 of the antenna is symmetric with the second section 34 of the antenna with respect to the symmetry plane 37. The partition plane 37 may extend exactly mid through the hearing aid, or the partition plane may extend anywhere between a first side of the hearing aid and a second side of the hearing aid.

In one or more embodiments, the first antenna section 31 has a first length, the second antenna section 34 has a second length, and the third antenna section 33 has a third length, and a sum of the first length, the second length and the third length is a total length of the antenna 25.

In one or more embodiments, a distance along and/or a length of the antenna is measured along the antenna structure.

In FIG. 3, L1 denotes the full length of the antenna 25, L2 denotes the distance between the first end 32 of the first antenna section 31 and a midpoint 30 of the third antenna section 33, and L3 denotes the distance between the first end 36 of the second antenna section 34 and a midpoint 30 of the third antenna section 33. The distances L2, L3 from the ends 32, 36, to the intersection 30 with the partition plane 37, respectively may be measured along the current path as shown in FIG. 3, or the distances L2, L3 may be measured along the shortest distance from the ends 32, 36, to the intersection with the partition plane 37.

According to an aspect of the disclosure, an absolute relative difference between the total length of the antenna and the wavelength is less than a threshold, such as 10% or 25%. The antenna dimensions which are the length of the antenna 25, L1, and distances L2, L3, may thus be defined according to the following:

$$\left|\frac{L_1-\lambda}{\lambda}\right| < T_1 \cap \left|\frac{L_3-L_2}{L_2}\right| < T_2$$

wherein λ is the wavelength. The absolute relative difference between the total length L1 of the antenna 25 and the wavelength λ is thus less than a threshold, T1, such as less than 25%.

The absolute relative difference between the distance L3 and the distance L2 is less than a threshold, T2, such as less than 25%.

In one or more embodiments, the distance between the two ends 32, 36 corresponds to the width of the hearing aid assembly.

In some embodiments, a distance from a first end of the first or second antenna section to the third antenna section may be between ¼λ and ½λ. The first length or the second length may be between ¼λ and ½λ.

The midpoint of the antenna may be positioned at the third section. In an embodiment, the antenna has a first end 32 and a second end 36 and a relative difference between a length of the antenna from the first end 32 to the midpoint 30 and from the second end 36 to the midpoint 30 is less than a threshold, such as less than 10% or 25%.

Figure 4:
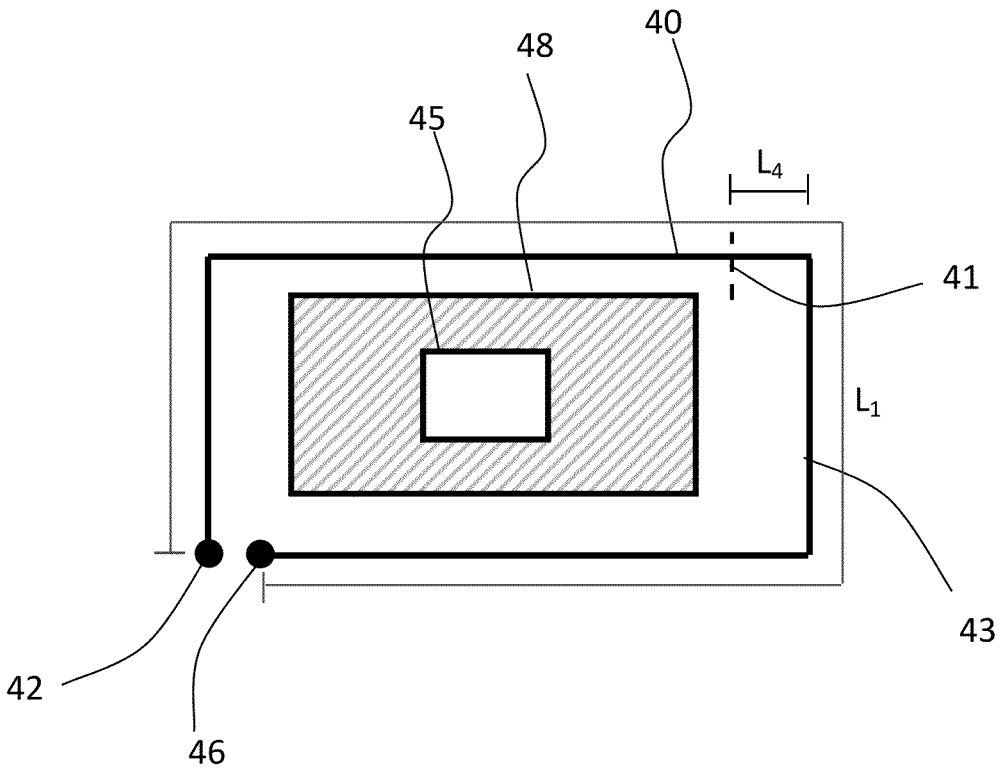
FIG. 4 shows schematically an exemplary implementation of a hearing aid comprising an antenna according to an embodiment of the present disclosure.

FIG. 4 shows an embodiment of a hearing aid comprising an antenna 40, a wireless communication unit 45, a ground plane 48, an antenna part 43 extending from one side to the other and two ends 42, 46. The antenna 40 has a midpoint 41 (or a centre) which is located on the antenna part 43 or located in such a way that a distance from the midpoint 41 to the antenna part 43 is not longer than λ/4. The distance from the midpoint 41 of antenna 40 and the antenna part 43 is denoted L4 in FIG. 4. The structure of antenna 40 may be designed in such a way that the following holds:

$$\left|\frac{L_4-\lambda/4}{\lambda/4}\right| < T_3$$

The absolute relative difference between the distance L4 and the quarter of a wavelength λ/4 is less than a threshold, T3, such as less than 10% or 25%.

The antenna may form a loop. The antenna comprising a first antenna section 31, a second antenna section 34, a third antenna section 33 may be structured in such a way that the first, second, and third sections are arranged to form a loop, such as an open loop.

In an embodiment, an antenna excitation point is provided at the first and/or the second end of the antenna. The excitation point may be provided at ends 32, 42 and/or at ends 36, 46.

Figure 5:
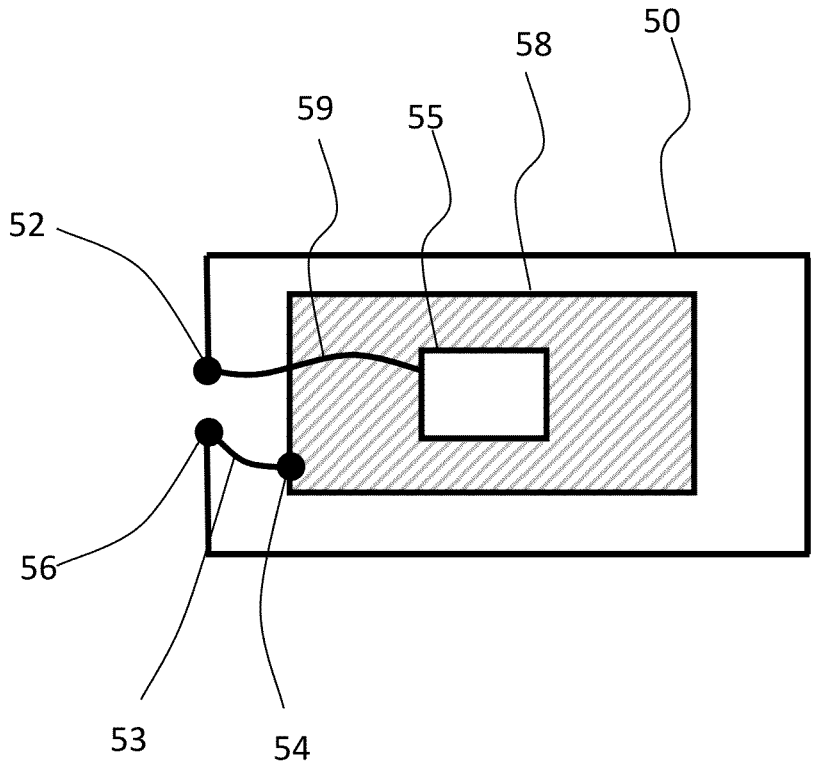
FIG. 5 shows schematically an exemplary implementation of a hearing aid comprising an antenna with an excitation point and a grounded end according to an embodiment of the present disclosure.

FIG. 5 shows an embodiment of a hearing aid comprising an antenna 50, a wireless communication unit 55, a ground plane 58, and an end 52 of the antenna 50 and another end 56 of the antenna 50. In FIG. 5, the end 52 is connected via transmission line 59 to the wireless communication unit 55 and plays thus the role of an excitation point. End 52 is configured so that the antenna conducts current of large amplitude at the desired transmission frequency of the electromagnetic field. Hereby, a major part of the power of the electromagnetic field emitted by the antenna 50 and propagating from the antenna 50 at one ear to either an opposite ear of the user or to an external device is contributed by a midpoint of the antenna 50. The antenna 50 is dimensioned so that the current has a maximum current amplitude at a proximity of the midpoint of the antenna, preferably located proximate a part of the antenna extending from one side of the hearing aid to another side of the hearing aid. The current induced in the antenna may have a first local maximum proximate the end point 52 and a second maximum proximate the midpoint of the antenna 50, depending on the excitation of the antenna 50.

In one or more embodiments, one end of the antenna is grounded. In FIG. 5, the end 56 is connected to a point 54 of the ground plane 58 via transmission line 53. The ground plane 58 may be a printed circuit board. The ground plane may be formed in any material capable of conducting a current upon excitation of the antenna. The ground plane may also be formed as a single conducting path of e.g. copper, for guiding the current. The ground plane may be a ground potential, such as a zero potential or a relative ground potential.

In one or more embodiments, the antenna is a dipole antenna, the dipole antenna comprising two excitation points, a first excitation point at a first end of the antenna and a second excitation point at another end of the antenna.

Figure 6:
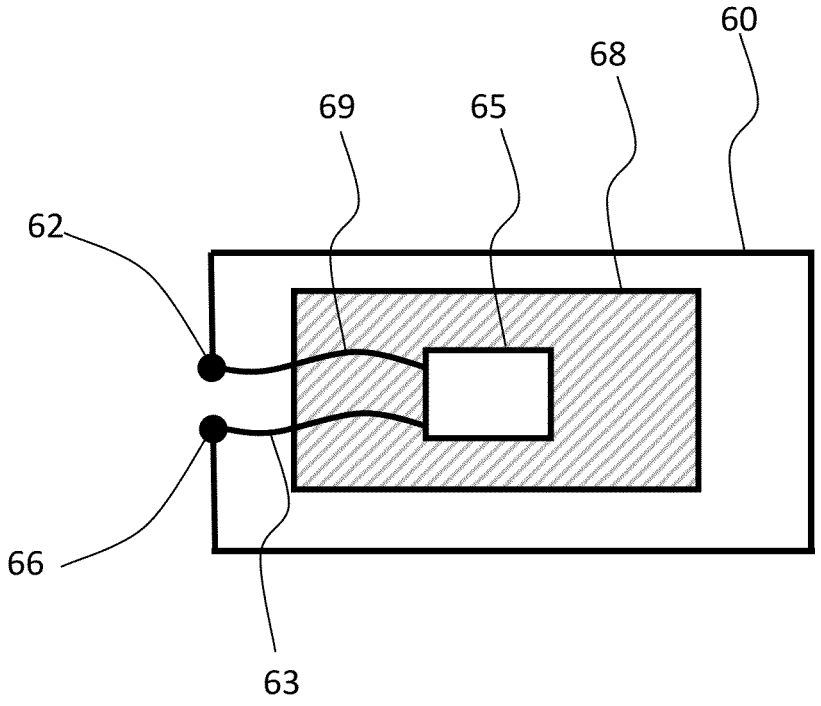
FIG. 6 shows schematically an exemplary implementation of a hearing aid comprising an antenna with two excitation points according to an embodiment of the present disclosure.

FIG. 6 shows schematically an exemplary implementation of the antenna with two excitation points according to an embodiment of the present disclosure. In FIG. 6, an embodiment of a hearing aid comprises an antenna 60, a wireless communication unit 65, a ground plane 68, and an end 62 of the antenna 60 and another end 66 of the antenna 60. End 62 at a first end of the antenna 60 is connected via transmission line 69 to the wireless communication unit 65 and plays thus the role of a first excitation point. Similarly, end 66, such as end 66, at a second end of the antenna 60 is connected via transmission line 63 to the wireless communication unit 65 and plays thus the role of a second excitation point. The antenna 60 is thus in the present example a dipole antenna.

In one or more embodiments, the first excitation point and the second excitation point, respectively, are configured so as to obtain a desired current distribution. For example, the first excitation point and the second excitation point may be adjacent each other, or may be positioned relatively close to each other.

Figure 7:
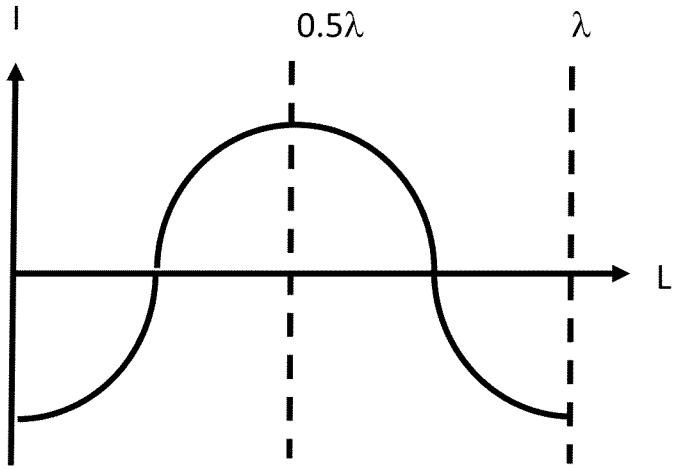
FIG. 7 is a diagram of the amplitude of the current as a function of a length of the antenna according to the present disclosure.

FIG. 7 is a diagram of the amplitude of the current as a function of a length of the antenna according to the present disclosure. FIG. 7 shows that a current running through the antenna oscillates periodically with a period equal to the wavelength λ. FIG. 7 also shows that a maximum amplitude of the current running through the antenna is reached at a length corresponding to half a wavelength λ/2. FIG. 7 supports a technical feature of the antenna disclosed herein, namely that the antenna disclosed herein is constructed in such a way as a maximum amplitude of the current running through the antenna is obtained proximate a midpoint of the antenna that is located in (or proximate) a part of the antenna extending from one side to another side of the hearing aid.

Figure 8:
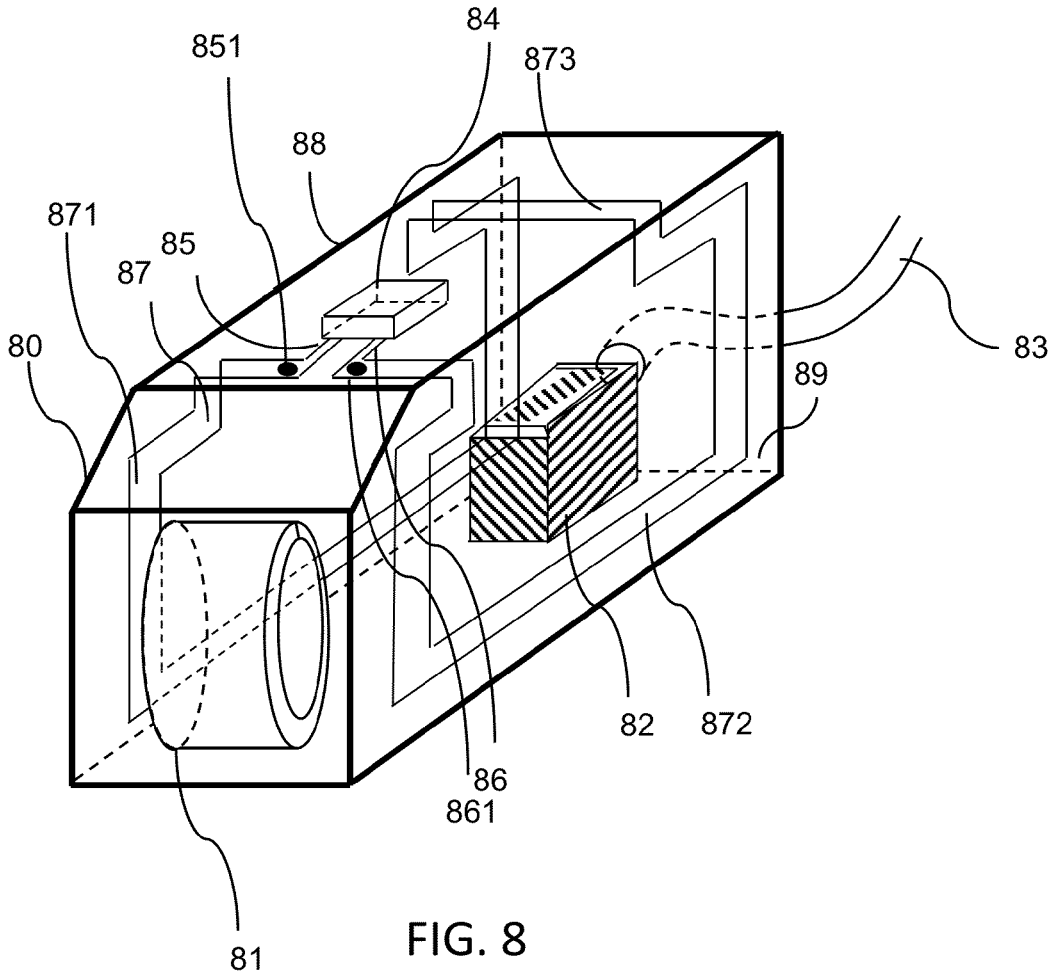
FIG. 8 shows an exemplary hearing aid having an antenna according to another embodiment.

FIG. 8 shows an exemplary hearing aid having an antenna according to another embodiment of the present disclosure. The hearing aid 80 comprises a battery 81, a signal processor 82, a sound tube 83 connecting to the inner ear, a radio or transceiver 84, transmission lines 85, 86 for feeding the antenna 87. The hearing aid has a first side 88 and a second side 89. In one or more embodiments, the antenna proximate the first side of the hearing aid, i.e. a first section 871 extends along or proximate the first side 88 of the hearing aid, and the antenna proximate the second side of the hearing aid, i.e. a second section 872 extends along or proximate a second side 89 of the hearing aid 80. The first section 871 is fed via transmission line 85 to feed point 851 and is thus an actively fed section 871. The second section 872 is fed via transmission line 86 to feed point 861 and thus forms a second actively fed part 872. The feed system for the antenna may thus comprise the first and second transmission lines 85, 86 and first and second feed points 851, 861 for feeding antenna 87. A third section 873 of the antenna 87 extends from proximate the first side 88 to proximate the second side 89 of the hearing aid assembly. The antenna 87 is constructed this way so as to achieve a maximum amplitude of the current running through the antenna 87 obtained at a midpoint of the antenna that is located in (or proximate) section 873 of the antenna extending from the first side 88 to the second side 89 of the hearing aid 80.

In one or more embodiments, the housing is a behind-the-ear housing configured to be positioned behind the ear of the user during use and the first side is a first longitudinal side of the hearing aid, and the second side is a second longitudinal side of the hearing aid.

Figure 9:
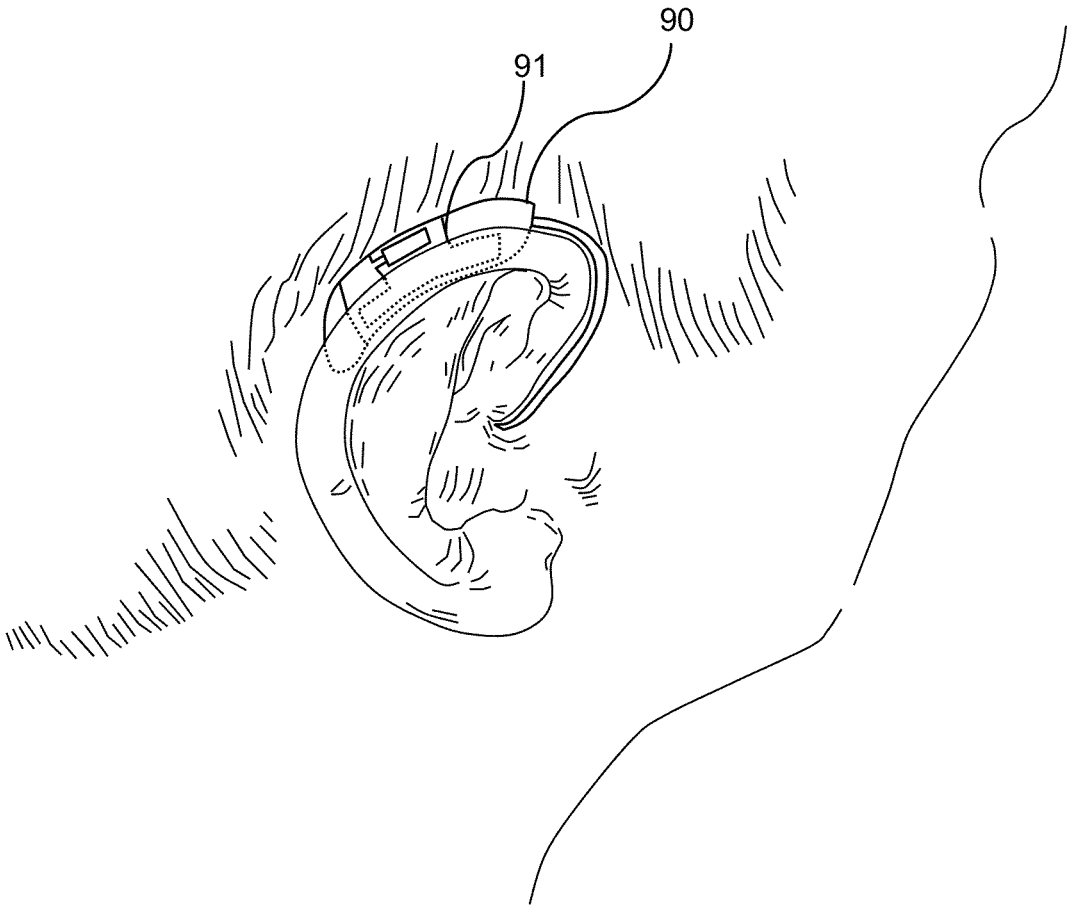
FIG. 9 shows a hearing aid positioned on the right ear of a user's head with the hearing aid comprising an antenna according to an embodiment of this disclosure.

FIG. 9 shows a hearing aid positioned on the right ear of a user's head with the hearing aid comprising an antenna disclosed herein. The hearing aid 90 of FIG. 9 comprises a behind-the-ear housing configured to be positioned behind the ear of the user during use. The hearing aid 90 comprises an antenna 91 as disclosed herein.

It is envisaged that even though only a behind-the-ear hearing aid have been shown in FIG. 9, the described antenna structure may be equally applied in all other types of hearing aids, including in-the-ear hearing aids, as long as the antenna is configured to provide a maximum current in a section extending from the first side of the hearing aid to the second side of the hearing aid as herein described.

As shown in FIG. 9, the first side may be positioned parallel with the surface of the head of a user when the housing is worn in its operational position by the user.

According to a further aspect, this disclosure relates to a binaural hearing aid system comprising at least one hearing aid disclosed herein.

FIG. 10 is a schematic view of the current distribution across a prior-art antenna with a small loop having a length smaller than λ/4. FIG. 10 shows schematically a prior art antenna having a total length smaller than λ/4. As hearing aids are very small in size and comprise many electronic and metallic components contained in a housing small enough to fit in the ear canal of a human or behind the outer ear, the antennas in hearing aids are usually smaller than λ/4. This leads to a current distribution that is relatively uniform across the antenna structure.

FIG. 11 is a schematic view of the current distribution across an antenna according an embodiment of the present disclosure. FIG. 10 shows schematically an antenna 110 as disclosed herein and a current distribution across the antenna 110. Due to the length and the structure of the antenna 110, the current distribution provides local maxima at the antenna ends as well as at the part 113 of the antenna that extends from one side to the other side of the hearing aid. The current running through antenna parts 111 and 112 has much lower amplitude. This results in the electric field being radiated in the desired direction for the surface wave to efficiently travel around the head of the user. An advantage of this is a more robust ear-to-ear wireless communication.

The specific wavelength, and thus the frequency of the emitted electromagnetic field, is of importance when considering communication involving an obstacle. In one or more embodiments, the obstacle is a head with a hearing aid comprising an antenna located closed to the surface of the head. If the wavelength is too long such as a frequency of 1 GHz and down to lower frequencies greater parts of the head will be located in the near field region. This results in a different diffraction making it more difficult for the electromagnetic field to travel around the head. If on the other hand the wavelength is too short, the head will appear as being too large an obstacle which also makes it difficult for electromagnetic waves to travel around the head. An optimum between long and short wavelengths is therefore preferred. In general the ear to ear communication is to be done in the band for industry, science and medical with a desired frequency centred around 2.4 GHz.

Although particular embodiments have been shown and described, it will be understood that it is not intended to limit the claimed inventions to the preferred embodiments, and it will be obvious to those skilled in the art that various changes and modifications may be made without department from the spirit and scope of the claimed inventions. The specification and drawings are, accordingly, to be regarded in an illustrative rather than restrictive sense. The claimed inventions are intended to cover alternatives, modifications, and equivalents.

The invention claimed is:

1. A hearing aid with an assembly, the assembly comprising:

a microphone for reception of sound and conversion of the received sound into a corresponding first audio signal;

a signal processor for processing the first audio signal into a second audio signal compensating a hearing loss of a user of the hearing aid;

a wireless communication unit configured for wireless data communication; and an antenna for emission of an electromagnetic field, the antenna being coupled with the wireless communication unit, the antenna having a total length between three quarters of a wavelength of the emitted electromagnetic field and five quarters of the wavelength;

wherein a part of the antenna extends from a first side of the assembly to a second side of the assembly; and wherein the antenna has a midpoint located at the part of the antenna extending from the first side to the second side.

2. The hearing aid according to claim 1, wherein a current running through the antenna has a maximum amplitude in the part of the antenna extending from a first side of the assembly during emission of the electromagnetic field.

3. The hearing aid according to claim 1, wherein the antenna forms a loop.

4. The hearing aid according to claim 1, wherein an absolute relative difference between the total length of the antenna and the wavelength is less than a threshold.

5. The hearing aid according to claim 1, wherein the second side is opposite the first side.

6. The hearing aid according to claim 1, wherein the microphone is a part of a behind-the-ear unit configured to be positioned behind an ear of the user during use, and wherein the first side is a first longitudinal side of the assembly, and the second side is a second longitudinal side of the assembly.

7. The hearing aid according to claim 1, wherein one end of the antenna is grounded.

8. The hearing aid according to claim 1, wherein the antenna has a first end and a second end, and a relative difference between a length of the antenna from the first end to the midpoint and a length from the second end to the midpoint is less than a threshold.

9. The hearing aid according to claim 1, wherein the antenna has an excitation point at a first end of the antenna, or two excitation points respectively at the first end and a second end of the antenna.

10. The hearing aid according to claim 1, wherein the antenna is a part of an assembly, and wherein the antenna has:

a first antenna section extending along the first side of the assembly, the first antenna section having a first end and a second end, a second antenna section extending along the second side of the assembly, the second antenna section having a first end and a second end, and a third antenna section, the third antenna section being connected with the second end of the first antenna section and with the second end of the second antenna section, wherein the first end of the first antenna section has an excitation point and/or the first end of the second antenna section has an excitation point.

11. The hearing aid according claim 10, wherein the first antenna section has a first length, the second antenna section has a second length, and the third antenna section has a third length, and wherein a sum of the first length, the second length and the third length is the total length of the antenna.

12. The hearing aid according to claim 10, wherein a distance from the first end of the first antenna section or the first end of the second antenna section to the third antenna section is between a quarter wavelength and a half wavelength.

13. The hearing aid according to claim 10, wherein the midpoint of the antenna is at the third section.

14. The hearing aid according to claim 10, wherein the third section is extending from proximate the first side to proximate the second side of the assembly.

15. The hearing aid according to claim 10, wherein a shape of the first section is symmetrical to a shape of the second section.

16. The hearing aid according to claim 1, wherein the antenna is configured to provide wireless communication around a head of a user of the hearing aid.

17. The hearing aid according to claim 1, wherein the antenna has a first excitation point that is closer to the first side of the assembly than the second side of the assembly, and a second excitation point that is closer to the second side of the assembly than the first side of the assembly.

18. The hearing aid according to claim 1, wherein the antenna is configured to operate at a frequency that is anywhere from 1 GHz to 3 GHz.

19. A hearing aid with an assembly, the assembly comprising:

a microphone for reception of sound and conversion of the received sound into a corresponding first audio signal;

a signal processor for processing the first audio signal into a second audio signal compensating a hearing loss of a user of the hearing aid;

a wireless communication unit configured for wireless data communication; and an antenna for emission of an electromagnetic field, the antenna being coupled with the wireless communication unit, the antenna having a total length between three quarters of a wavelength of the emitted electromagnetic field and five quarters of the wavelength;

wherein a part of the antenna extends from a first side of the assembly to a second side of the assembly; and wherein a distance between a midpoint of the antenna and the part of the antenna is less than a quarter of the wavelength.

20. The hearing aid according to claim 19, wherein a current running through the antenna has a maximum amplitude in the part of the antenna extending from a first side of the assembly during emission of the electromagnetic field.

21. The hearing aid according to claim 19, wherein the antenna forms a loop.

22. The hearing aid according to claim 19, wherein an absolute relative difference between the total length of the antenna and the wavelength is less than a threshold.

23. The hearing aid according to claim 19, wherein the second side is opposite the first side.

24. The hearing aid according to claim 19, wherein the microphone is a part of a behind-the-ear unit configured to be positioned behind an ear of the user during use, and wherein the first side is a first longitudinal side of the assembly, and the second side is a second longitudinal side of the assembly.

25. The hearing aid according to claim 19, wherein one end of the antenna is grounded.

26. The hearing aid according to claim 19, wherein the antenna has a first end and a second end, and a relative difference between a length of the antenna from the first end to the midpoint and a length from the second end to the midpoint is less than a threshold.

27. The hearing aid according to claim 19, wherein the antenna has an excitation point at a first end of the antenna, or two excitation points respectively at the first end and a second end of the antenna.

28. The hearing aid according to claim 19, wherein the antenna is a part of an assembly, and wherein the antenna has:

a first antenna section extending along the first side of the assembly, the first antenna section having a first end and a second end, a second antenna section extending along the second side of the assembly, the second antenna section having a first end and a second end, and a third antenna section, the third antenna section being connected with the second end of the first antenna section and with the second end of the second antenna section, wherein the first end of the first antenna section has an excitation point and/or the first end of the second antenna section has an excitation point.

29. The hearing aid according claim 28, wherein the first antenna section has a first length, the second antenna section has a second length, and the third antenna section has a third length, and wherein a sum of the first length, the second length and the third length is the total length of the antenna.

30. The hearing aid according to claim 28, wherein a distance from the first end of the first antenna section or the first end of the second antenna section to the third antenna section is between a quarter wavelength and a half wavelength.

31. The hearing aid according to claim 28, wherein the midpoint of the antenna is at the third section.

32. The hearing aid according to claim 28, wherein the third section is extending from proximate the first side to proximate the second side of the assembly.

33. The hearing aid according to claim 28, wherein a shape of the first section is symmetrical to a shape of the second section.

34. The hearing aid according to claim 19, wherein the antenna is configured to provide wireless communication around a head of a user of the hearing aid.

35. The hearing aid according to claim 19, wherein the antenna has a first excitation point that is closer to the first side of the assembly than the second side of the assembly, and a second excitation point that is closer to the second side of the assembly than the first side of the assembly.

36. The hearing aid according to claim 19, wherein the antenna is configured to operate at a frequency that is anywhere from 1 GHz to 3 GHz.

* * * * *